US008248190B2

(12) United States Patent
Tamura et al.

(10) Patent No.: US 8,248,190 B2
(45) Date of Patent: Aug. 21, 2012

(54) RESONATOR AND FILTER USING THE SAME

(75) Inventors: Masaya Tamura, Osaka (JP); Toshio Ishizaki, Hyogo (JP)

(73) Assignee: Panasonic Corporation, Osaka (JP)

( * ) Notice: Subject to any disclaimer, the term of this patent is extended or adjusted under 35 U.S.C. 154(b) by 338 days.

(21) Appl. No.: 12/674,078

(22) PCT Filed: Aug. 20, 2008

(86) PCT No.: PCT/JP2008/002247

§ 371 (c)(1),
(2), (4) Date: Feb. 18, 2010

(87) PCT Pub. No.: WO2009/028153

PCT Pub. Date: Mar. 5, 2009

(65) Prior Publication Data

US 2010/0201460 A1 Aug. 12, 2010

(30) Foreign Application Priority Data

Aug. 24, 2007 (JP) ..... 2007-217941

(51) Int. Cl.
*H01P 1/203* (2006.01)
*H01P 7/08* (2006.01)

(52) U.S. Cl. ..... 333/204; 333/219; 333/185

(58) Field of Classification Search ..... 333/185, 333/204, 205, 219, 235, 175
See application file for complete search history.

(56) References Cited

U.S. PATENT DOCUMENTS

| | | | | |
|---|---|---|---|---|
| 5,055,809 | A | 10/1991 | Sugawa et al. | |
| 5,446,430 | A * | 8/1995 | Yamanaka et al. | 333/202 |
| 6,307,449 | B1 * | 10/2001 | Matsuo et al. | 333/202 |
| 6,445,266 | B1 * | 9/2002 | Nagatomi et al. | 333/204 |
| 6,768,399 | B2 * | 7/2004 | Uriu et al. | 333/204 |
| 6,771,147 | B2 * | 8/2004 | Mongia | 333/204 |
| 7,312,676 | B2 * | 12/2007 | Kundu | 333/204 |
| 7,525,711 | B1 * | 4/2009 | Rule et al. | 359/244 |
| 2004/0085164 | A1 | 5/2004 | Hirabayashi | |
| 2005/0190017 | A1 | 9/2005 | Hirabayashi | |
| 2006/0091979 | A1 | 5/2006 | Chang | |

FOREIGN PATENT DOCUMENTS

| | | | |
|---|---|---|---|
| DE | 102006023431 | A1 | 11/2006 |
| GB | 2260651 | A | 4/1993 |
| JP | 2-249303 | A | 5/1990 |
| JP | 11-186807 | A | 7/1999 |
| JP | 2003-198226 | A | 7/2003 |
| JP | 2004031601 | A | 1/2004 |
| JP | 2005-045447 | A | 2/2005 |
| JP | 2005-057531 | A | 3/2005 |

OTHER PUBLICATIONS

European Application Serial No. 08828167.0, Extended European Search Report mailed Nov. 29, 2011, 6 pgs.

(Continued)

*Primary Examiner* — Seungsook Ham
(74) *Attorney, Agent, or Firm* — RatnerPrestia

(57) ABSTRACT

The resonator includes first high-impedance wiring plate-like, arranged parallel to top-surface ground electrode; second high-impedance wiring plate-like, arranged so as to face first high-impedance wiring; first columnar conductor electrically connecting first high-impedance wiring to second high-impedance wiring; first low-impedance wiring arranged between first high-impedance wiring and second high-impedance wiring; second columnar conductor electrically connecting first high-impedance wiring to first low-impedance wiring; second low-impedance wiring arranged between first low-impedance wiring and second high-impedance wiring; and third columnar conductor electrically connecting second high-impedance wiring to second low-impedance wiring, to reduce the area size the resonator.

9 Claims, 10 Drawing Sheets

OTHER PUBLICATIONS

Mu, Yani, "Multilayered Stripline Interdigital-Hairpin Bandpass Filters with Small-Size and Improved Stopband Characteristics", Microwave Conference Proceedings, 2005. APMC 2005. Asia-Pacific Conference Proceedings (Dec. 4-7, 2005), 4 pgs.

Settaluri, Raghu K., "Compact Multi-Level Folded-Line Bandpass Filters", Microwave Symposium Digest. (2000) IEEE MTT-S International, (2000) 4 pgs.

International Search Report for PCT/JP2008/002247, Nov. 11, 2008.

* cited by examiner

RESONATOR AND FILTER USING THE SAME

This application is a U.S. National Phase Application of PCT International Application PCT/JP2008/002247.

TECHNICAL FIELD

The present invention relates to a resonator used for various types of electronic appliances such as a mobile phone and to a filter and an electronic device including the resonator.

BACKGROUND ART

FIG. 12 is a top view of a conventional resonator. In FIG. 12, there are plate-like low-impedance wiring 1*a*, 1*b* and plate-like high-impedance wiring 2*a*, 2*b* arranged on the same plane. Then, one end of low-impedance wiring 1*a* is electrically connected to one end of high-impedance wiring 2*a*. Similarly, one end of low-impedance wiring 1*b* is electrically connected to one end of high-impedance wiring 2*b*. Further, the other end of high-impedance wiring 2*a* is electrically connected to the other end of high-impedance wiring 2*b*. Prior art documents on this patent application include patent literature 1, for instance.

In the configuration of the above-described conventional resonator, however, with plate-like low-impedance wiring 1*a*, 1*b* and plate-like high-impedance wiring 2*a*, 2*b* arranged on the same plane, the area size of the resonator is given by summing the area sizes of four wiring 1*a*, 1*b*, 2*a*, 2*b*. Accordingly, reducing the area size of a resonator is difficult.

[Patent literature 1] Japanese Patent Unexamined Publication No. H02-249303

SUMMARY OF THE INVENTION

The present invention helps reduce the area size of a resonator.

A resonator of the present invention includes a top-surface ground electrode; a plate-like first high-impedance wiring arranged parallel to the top-surface ground electrode; a plate-like second high-impedance wiring arranged so as to face the first high-impedance wiring; a first columnar conductor electrically connecting the first high-impedance wiring to the second high; a first low-impedance wiring arranged between the first and second high-impedance wiring; a second columnar conductor electrically connecting the first high-impedance wiring to the first low; and a third columnar conductor electrically connecting the second high-impedance wiring to the second low. Such a configuration allows the resonator to be structured three-dimensionally. The area size of a resonator is reduced by making the size smaller than the sum of the area sizes of the first and second high-impedance wiring, and the first and second low-impedance wiring.

REFERENCE MARKS IN THE DRAWINGS

3, 13 Dielectric laminated substrate
4, 14 Top-surface ground electrode
5, 15 Bottom-surface ground electrode
6*a*, 6*b*, 16*a*, 16*b* Side-surface ground electrode
7*a*, 17*a* First high-impedance wiring
7*b*, 17*b* Second high-impedance wiring
8*a*, 18*a* First low-impedance wiring
8*b*, 18*b* Second low-impedance wiring
9*a*, 19*a* First columnar conductor
9*b*, 19*b* Second columnar conductor
9*c*, 19*c* Third columnar conductor
10*a*, 10*b* I/O terminal
11*a*, 11*b* Columnar conductor
12*a*, 12*b* I/O wiring
20*a*, 20*b*, 21*a*, 21*b* Loading capacitance
22 Virtual ground surface
23 Interstage coupling device
24*a*, 24*b* Input coupling device
25*a*, 25*b* Output coupling device

DETAILED DESCRIPTION OF PREFERRED EMBODIMENTS

First Exemplary Embodiment

Figure 1:
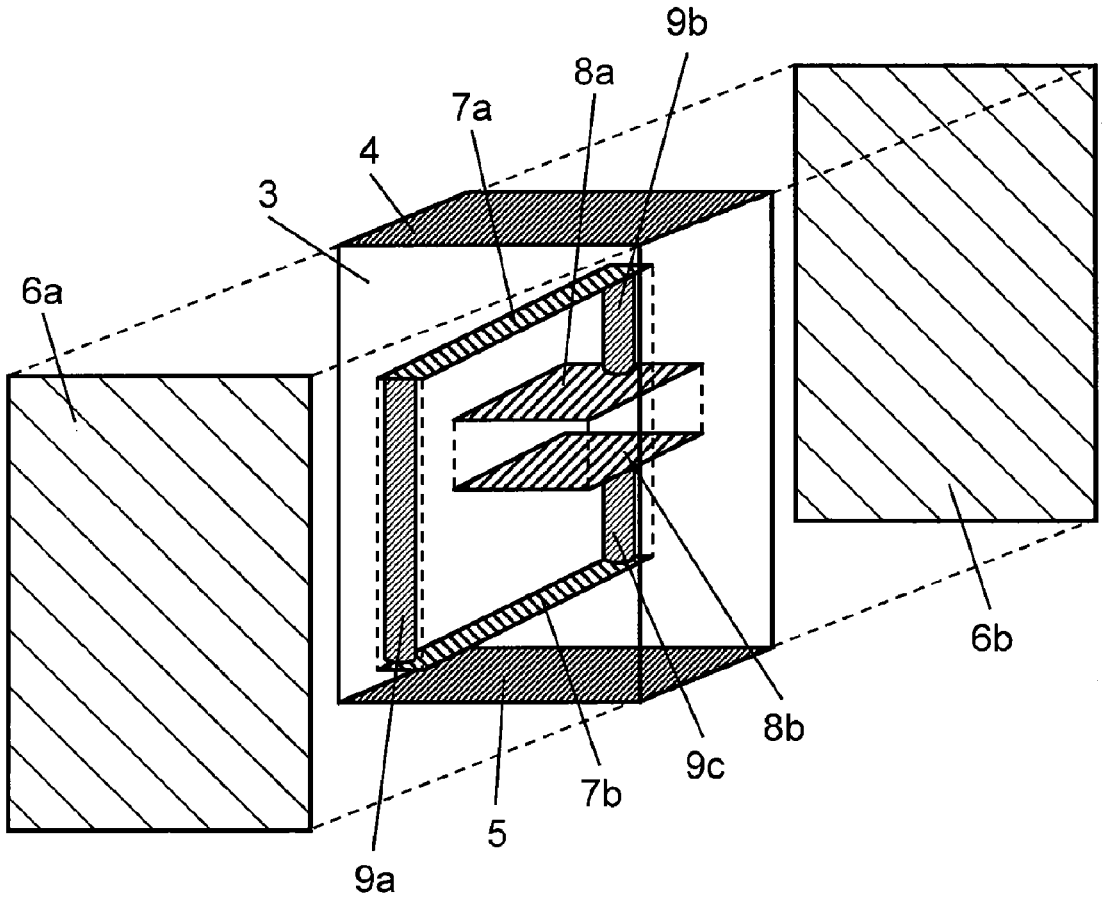
FIG. 1 is a perspective view of a resonator according to the first exemplary embodiment of the present invention.

FIG. 1 is a perspective view of a resonator according to the first exemplary embodiment of the present invention. In FIG. 1, the resonator according to the first embodiment has top-surface ground electrode 4 on the top surface of dielectric laminated substrate 3 and bottom-surface ground electrode 5 on the bottom surface of dielectric laminated substrate 3, each arranged so as to face the other. The inside of dielectric laminated substrate 3 interposed between top-surface ground electrode 4 and bottom-surface ground electrode 5 contains first and second high-impedance wiring 7*a*, 7*b*; first and second low-impedance wiring 8*a*, 8*b*; and first, second, and third columnar conductors 9*a*, 9*b*, 9*c*. First and second high-impedance wiring 7*a*, 7*b* are respectively arranged so as to face top- and bottom-surface ground electrodes 4, 5. Similarly, first and second low-impedance wiring 8*a*, 8*b* are respectively arranged so as to face top- and bottom-surface ground electrodes 4, 5.

First high-impedance wiring 7*a* is arranged near and parallel to top-surface ground electrode 4. Second high-impedance wiring 7*b* is arranged near and parallel to bottom-surface ground electrode 5. First high-impedance wiring 7*a* is arranged so as to face second high-impedance wiring 7*b*. Then, first columnar conductor 9*a* is connected to one end of first high-impedance wiring 7*a* and to one end of second high-impedance wiring 7*b* (both at the same side).

Here, the length of second columnar conductor 9*b* is made equal to that of third columnar conductor 9*c*. Second and third columnar conductor 9*b*, 9 are arranged on the same straight line. Here, the length of the first columnar conductor is larger than the sum of the lengths of the second and third columnar conductors.

The other end of first high-impedance wiring 7*a* is connected to one end of first low-impedance wiring 8*a* arranged so as to face first high-impedance wiring 7*a* through second columnar conductor 9*b*. The other end of first low-impedance wiring 8*a* is open with nothing connected thereto. In other words, first columnar conductor 9*a* is not electrically connected to first low-impedance wiring 8*a*.

Second low-impedance wiring 8*b* is arranged so as to face first low-impedance wiring 8*a*. Then, the other end of second low-impedance wiring 8*b* is connected to the other end of second high-impedance wiring 7*b* through third columnar conductor 9*c*. First low-impedance wiring 8*a* is not electrically connected to second low-impedance wiring 8*b*. The one end of second low-impedance wiring 8*b* is open with nothing connected thereto. In other words, first columnar conductor 9*a* is not electrically connected to second low-impedance wiring 8*b*.

Figure 2A:
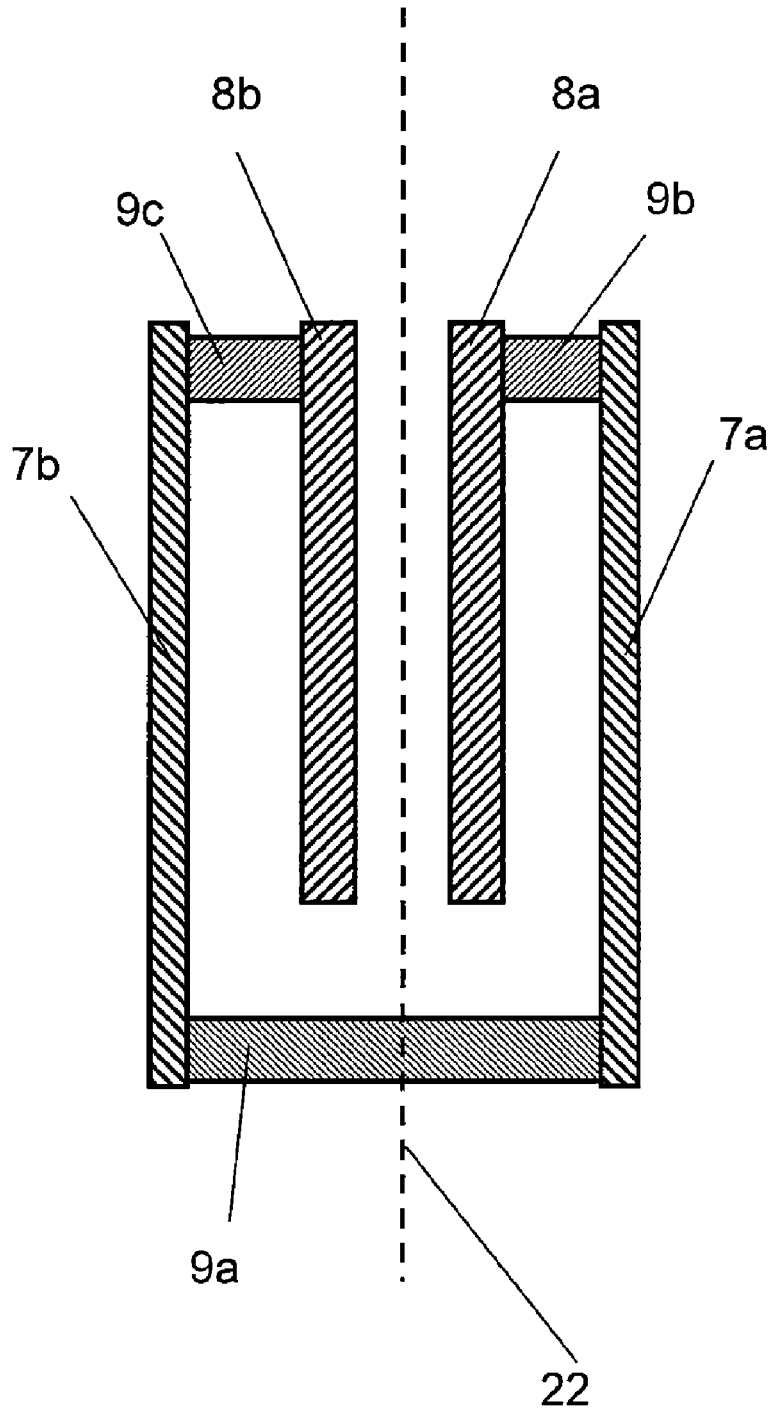
FIG. 2A is a sectional view of the resonator according to the first embodiment of the present invention.
Figure 2B:
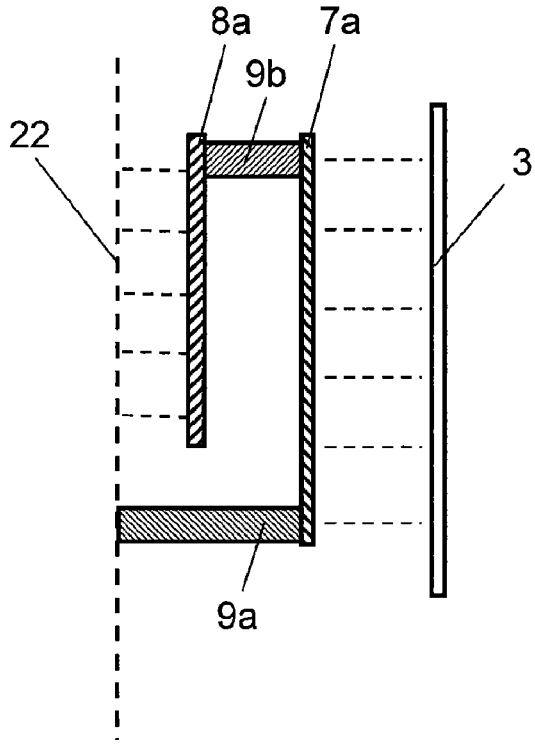
FIG. 2B is an enlarged figure of one half side of the sectional view of the resonator according to the first embodiment of the present invention.
Figure 2C:
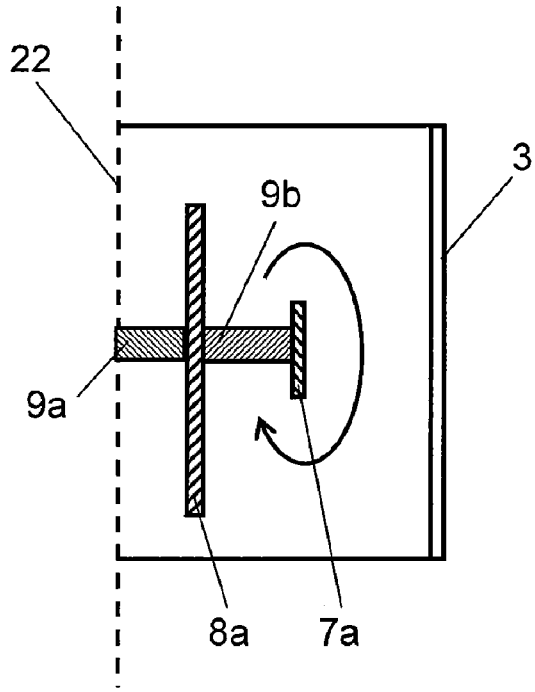
FIG. 2C is a sectional view of FIG. 2B viewed from the top surface.

FIG. 2A is a sectional view of the resonator according to the first embodiment of the present invention. FIG. 2B is an enlarged figure of one half side of the sectional view of the resonator according to the first embodiment of the present invention. FIG. 2C is a sectional view of FIG. 2B viewed from the top surface. In FIGS. 2A through 2C, the resonator according to the first embodiment of the present invention is supposed to have virtual ground surface 22 (shown by the dashed-dotted line) with the center between first low-impedance wiring 8*a* and second low-impedance wiring 8*b* being a boundary. Accordingly, electric flux lines from first low-impedance wiring 8*a* and second low-impedance wiring 8*b* occur to virtual ground surface 22 (refer to FIG. 2B). Hence, the impedance of first low-impedance wiring 8*a* is determined by the distance between first low-impedance wiring 8*a* and virtual ground surface 22. In the same way, the impedance of second low-impedance wiring 8*b* is determined by the distance between second low-impedance wiring 8*b* and virtual ground surface 22.

Meanwhile, electric flux lines from first high-impedance wiring 7*a* occur to top-surface ground electrode 4 as shown by the broken lines in FIG. 2B. Consequently, the impedance of first high-impedance wiring 7*a* is determined by the distance between first high-impedance wiring 7*a* and top-surface ground electrode 4. In the same way, electric flux lines from second high-impedance wiring 7*b* occur to bottom-surface ground electrode 5. Consequently, the impedance of second high-impedance wiring 7*b* is determined by the distance between second high-impedance wiring 7*b* and bottom-surface ground electrode 5.

Currents flow in opposite directions between first high-impedance wiring 7*a* and first low-impedance wiring 8*a*; and second high-impedance wiring 7*b* and second low-impedance wiring 8*b*. However, the line width of first high-impedance wiring 7*a* is different from that of first low-impedance wiring 8*a*, for instance, and thus a current generated in first high-impedance wiring 7*a* is not completely canceled by that in first low-impedance wiring 8*a*. Consequently, magnetic force lines occur as shown by the solid line in FIG. 2C to influence each impedance.

For instance, the line width of the first high-impedance wiring may be made smaller than that of the first low-impedance wiring. The line width of the second high-impedance wiring may be made smaller than that of the second low-impedance wiring.

Thus, the impedances of first and second high-impedance wiring 7*a*, 7*b* are respectively determined by the distance to top-surface ground electrode 4 and to bottom-surface ground electrode 5, namely the conductor length of first columnar conductor 9*a*. Accordingly, the resonance frequency of the resonator according to the first embodiment of the present invention can be controlled.

Further, the distance between first low-impedance wiring 8*a* and virtual ground surface 22 is determined by the conductor length of second columnar conductor 9*b*. The distance between second low-impedance wiring 8*b* and virtual ground surface 22 is determined by the conductor length of third columnar conductor 9*c*. Accordingly, the resonance frequency of the resonator according to the first embodiment of the present invention can be controlled.

With the above-described configuration, a half-wavelength resonator can be structured three-dimensionally, and thus the area size of the resonator can be made smaller than the sum of the area sizes of first high-impedance wiring 7*a*, second high-impedance wiring 7*b*, first low-impedance wiring 8*a*, and second low-impedance wiring 8*b*. Consequently, the area size of a resonator can be reduced.

For instance, assumption is made that the relative dielectric constant of dielectric laminated substrate 3 shown in FIG. 1 is 57, the area size of dielectric laminated substrate 3 is 2,500 μm by 2,000 μm, and the thickness of dielectric laminated substrate 3 is 500 μm. The electrode thickness of top-surface ground electrode 4 and bottom-surface ground electrode 5 is 10 μm. The line width of first high-impedance wiring 7*a* and second high-impedance wiring 7*b* is 200 μm; the line length, 775 μm; and the line thickness, 10 μm. The line width of first low-impedance wiring 8*a* and second low-impedance wiring 8*b* is 600 μm; the line length, 1,025 μm; and the line thickness, 10 μm. Further, the center of the distance between first low-impedance wiring 8*a* and second low-impedance wiring 8*b* is made agree with the center of the thickness of the dielectric laminated substrate. The diameter of each of first columnar conductor 9*a*, second columnar conductor 9*b*, and third columnar conductor 9*c* is 100 μm.

Figure 3:
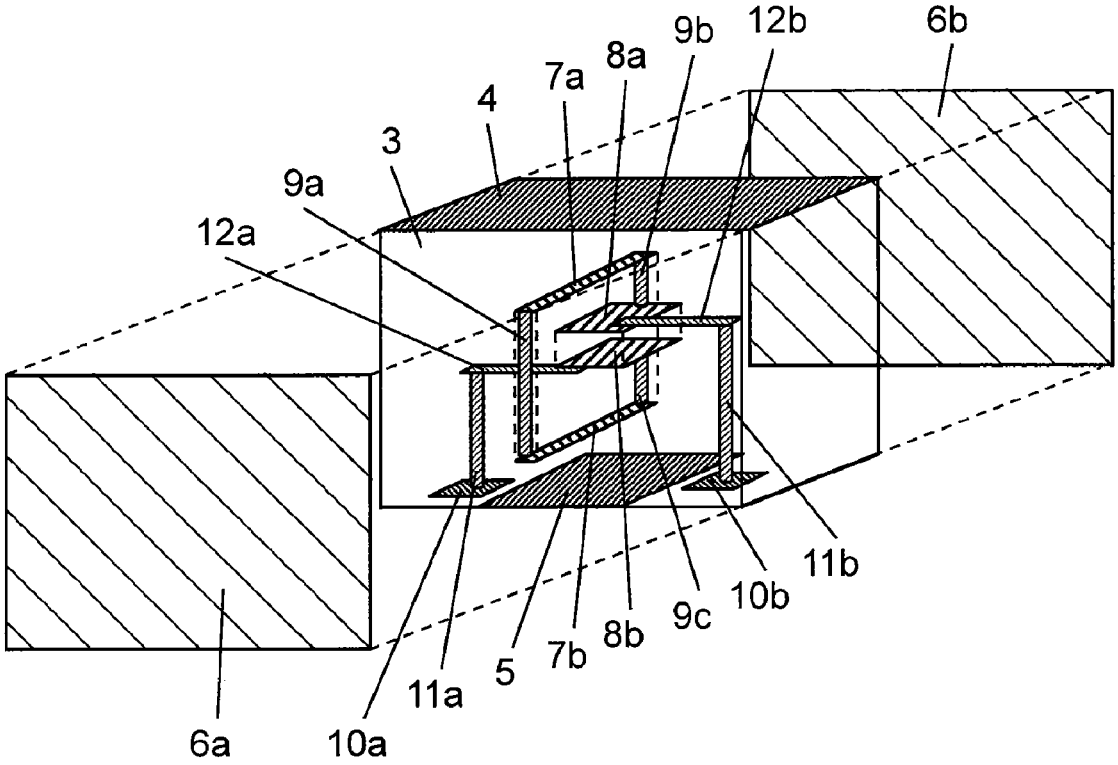
FIG. 3 is a perspective view showing an example configuration for characterizing the resonator according to the first embodiment of the present invention.

FIG. 3 is a perspective view showing an example configuration for characterizing the resonator according to the first embodiment of the present invention. In FIG. 3, I/O terminals 10*a*, 10*b* placed at bottom-surface ground electrode 5 are provided therefrom with I/O wiring 12*a*, 12*b* through columnar conductors 11*a*, 11*b*. I/O wiring 12*a*, 12*b* are respectively arranged so as to capacitively couple to the open ends of first low-impedance wiring 8*a* and second low-impedance wiring 8*b* at an interval of 20 μm in an area size of 200 μm by 100 μm.

Figure 4:
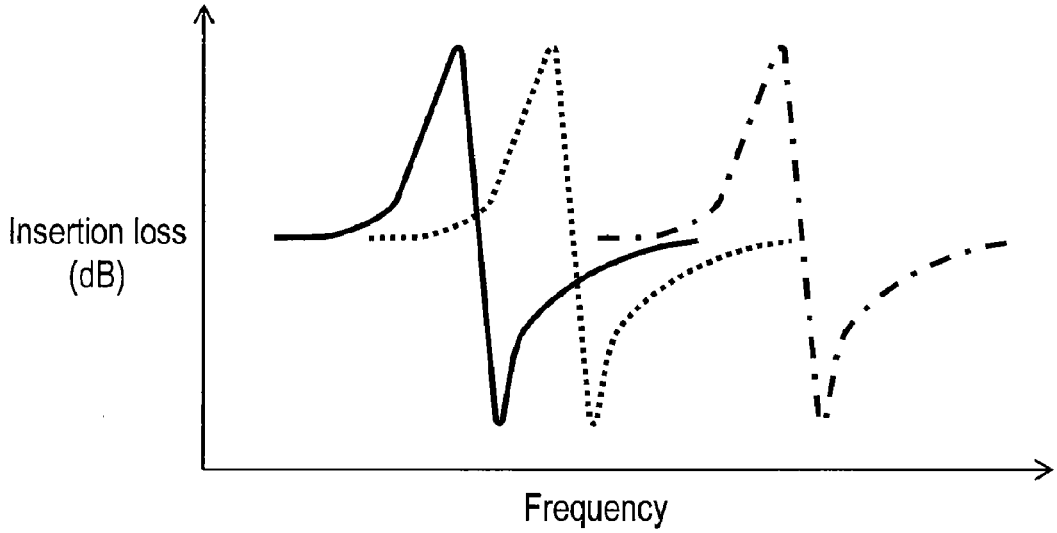
FIG. 4 is a characteristic diagram of the resonator according to the first embodiment of the present invention.

FIG. 4 is a characteristic diagram of the resonator according to the first embodiment of the present invention. In FIG. 4, the conductor length of first columnar conductor 9*a* is variable (140, 260, 380 μm). The length of 140 μm corresponds to the solid line; 260 μm, broken line; and 380 μm, dashed-dotted line. In this case, increasing the conductor length of first columnar conductor 9*a* raises the resonance frequency of the resonator.

Figure 5:
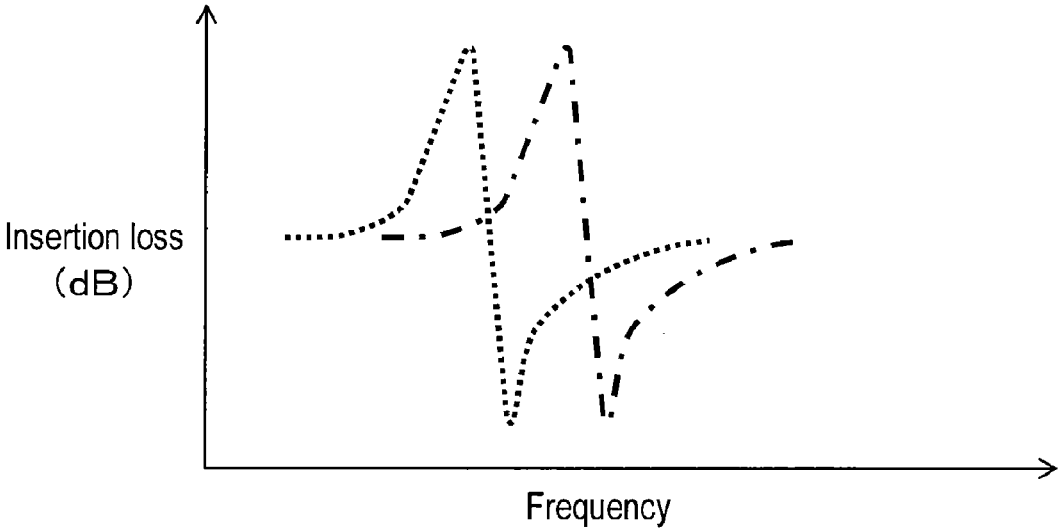
FIG. 5 is another characteristic diagram of the resonator according to the first embodiment of the present invention.

FIG. 5 is another characteristic diagram of the resonator according to the first embodiment of the present invention. In FIG. 5, the conductor length of first columnar conductor 9*a* is fixed to 380 μm, while those of second columnar conductor 9*b* and third columnar conductor 9*c* are variable (110 μm and 140 μm respectively). The length of 110 μm corresponds to the broken line; and 140 μm, dashed-dotted line. In this case, extending second columnar conductor 9*b* and third columnar conductor 9*c* raises the resonance frequency of the resonator.

In this way, adjusting the conductor lengths of first columnar conductor 9*a*, second columnar conductor 9*b*, and third columnar conductor 9*c* allows controlling the resonance frequency.

Figure 6:
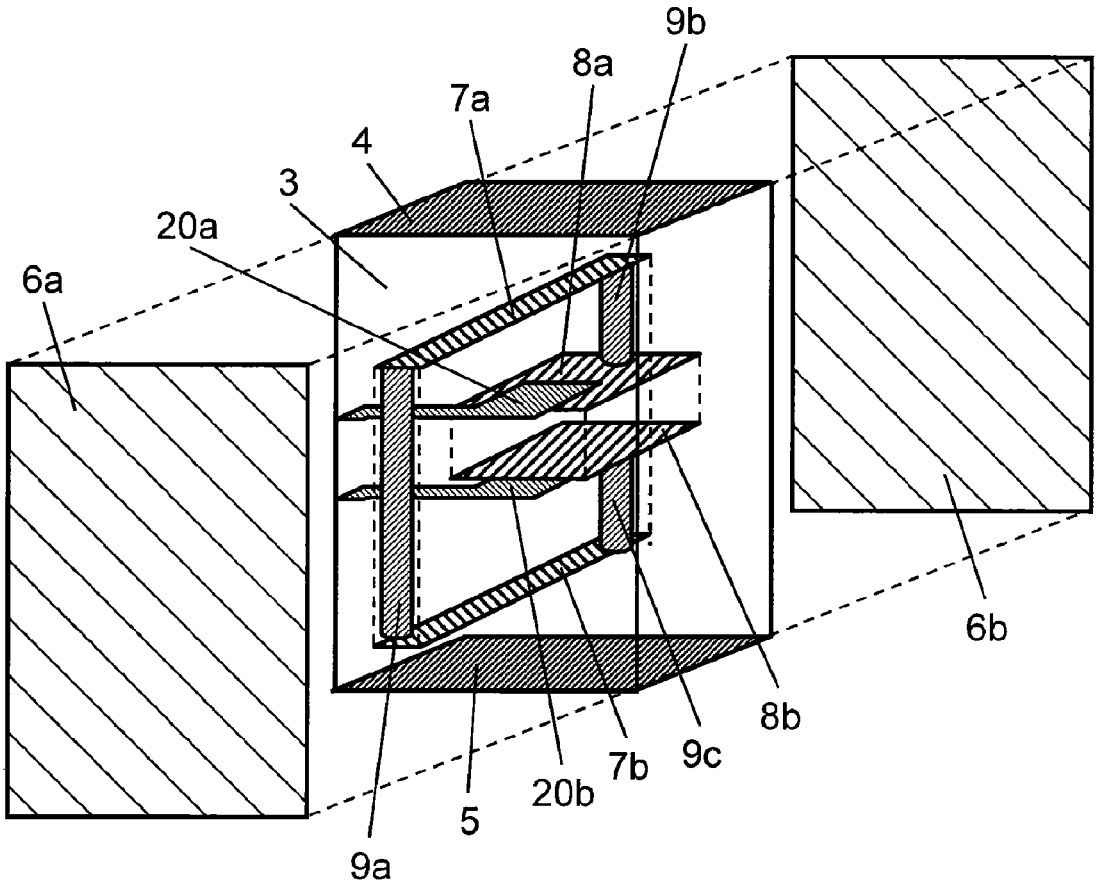
FIG. 6 is a perspective view of another resonator according to the first embodiment of the present invention.

FIG. 6 is a perspective view of another resonator according to the first embodiment of the present invention. In FIG. 6, loading capacitance 20*a* is provided between first low-impedance wiring 8*a* and first high-impedance wiring 7*a*, at the open end of first low-impedance wiring 8*a*. Loading capacitance 20*b* is provided between second low-impedance wiring 8*b* and second high-impedance wiring 7*b*, at the open end of second low-impedance wiring 8*b*. With such a composition, the resonance frequency of the resonator can be further shifted toward a lower frequency.

In the first embodiment of the present invention, to avoid electromagnetic field coupling with another electronic appliance, both top-surface ground electrode 4 and bottom-surface ground electrode 5 are desirably connected to side-surface ground electrodes 6*a*, 6*b* electrically. Here, the same effect is provided even if top-surface ground electrode 4 is electrically connected to bottom-surface ground electrode 5 using a columnar conductor instead of side-surface ground electrodes 6*a*, 6*b*.

In the first embodiment of the present invention, first high-impedance wiring 7*a* is different from second high-impedance wiring 7*b* in shape; first low-impedance wiring 8*a* is different from second low-impedance wiring 8*b* in shape, which allows a coupling device for such as I/O coupling and interstage coupling to be provided more easily. Further, second columnar conductor 9*b* is different from third columnar conductor 9*c* in conductor length, which allows a coupling device for such as I/O coupling and interstage coupling to be provided more easily. That is, such an asymmetric structure allows correcting fluctuation in impedance of the resonator caused by a coupling device.

Figure 7:
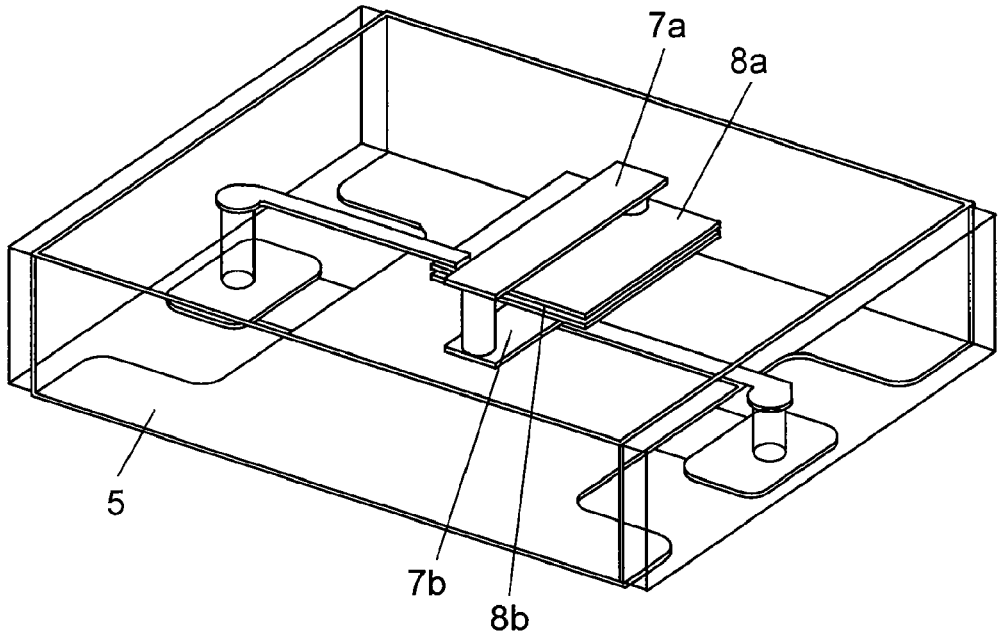
FIG. 7 is a perspective view showing another embodiment of the resonator according to the first embodiment of the present invention.

FIG. 7 is a perspective view showing another embodiment of the resonator according to the first embodiment of the present invention. In FIG. 7, enlarging the shape of bottom-surface ground electrode 5 provides a more stable ground surface.

Figure 8:
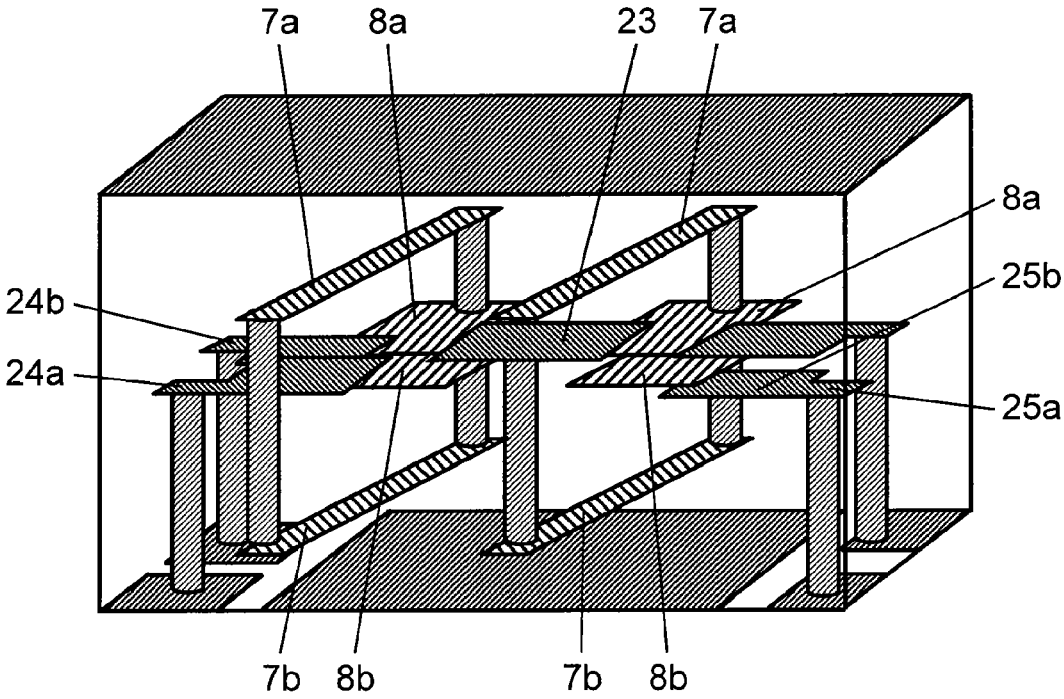
FIG. 8 is a perspective view showing a filter including the resonator according to the first embodiment of the present invention.

FIG. 8 is a perspective view showing a filter including the resonator according to the first embodiment of the present invention. In FIG. 8, two or more resonators of the present invention are used; they are connected with each other through electromagnetic field coupling by interstage coupling device 23; and by input coupling devices 24*a*, 24*b* and output coupling devices 25*a*, 25*b*. With such a structure, a further smaller filter can be produced.

Incorporating such a filter further reduces the size of an electronic device contained in a mobile phone and other appliances.

Second Exemplary Embodiment

Figure 9:
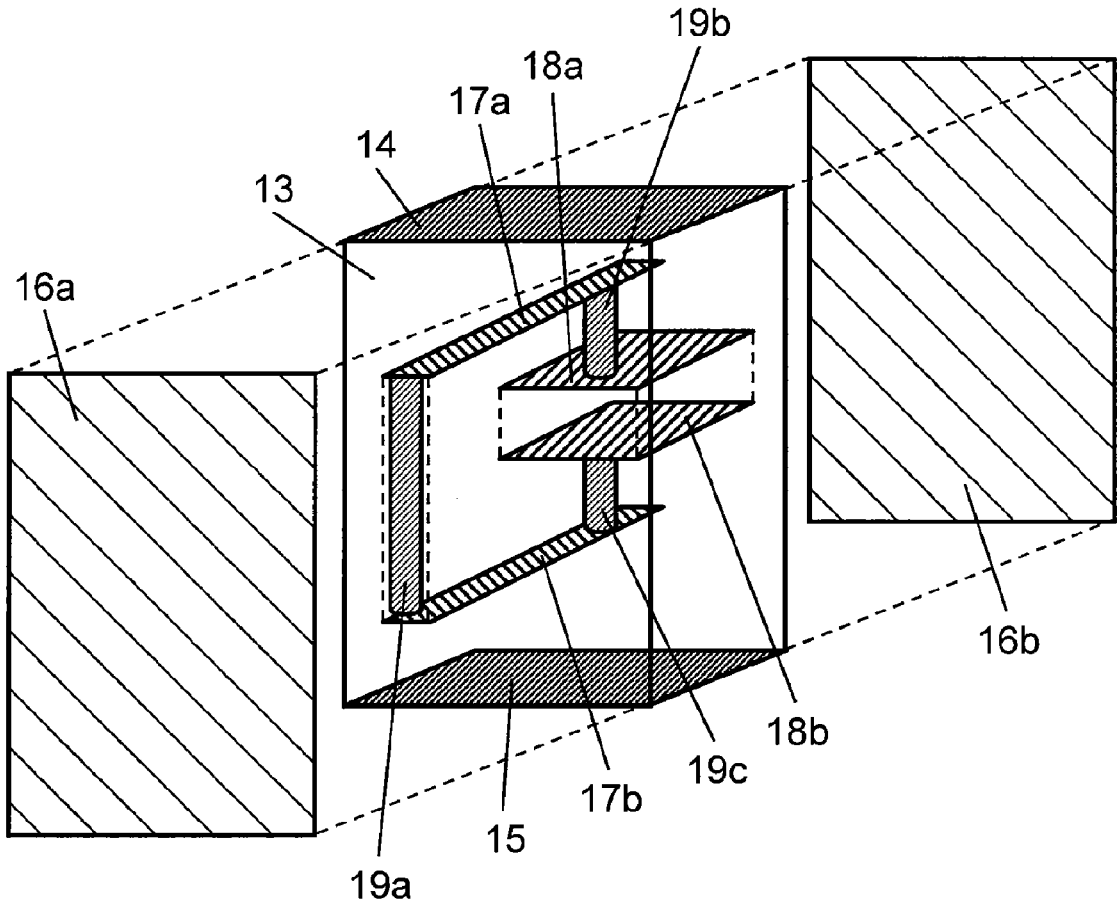
FIG. 9 is a perspective view of a resonator according to the second exemplary embodiment of the present invention.

FIG. 9 is a perspective view of a resonator according to the second exemplary embodiment of the present invention. In FIG. 9, the top and bottom surfaces of dielectric laminated substrate 13 respectively have top-surface ground electrode 14 and bottom-surface ground electrode 15 arranged thereon so as to face each other. The inside of dielectric laminated substrate 13 interposed between top-surface ground electrode 14 and bottom-surface ground electrode 15 contains first high-impedance wiring 17*a*, second high-impedance wiring 17*b*, first low-impedance wiring 18*a*, second low-impedance wiring 18*b*, first columnar conductor 19*a*, second columnar conductor 19*b*, and third columnar conductor 19*c*. First high-impedance wiring 17*a* and second high-impedance wiring 17*b* are arranged so as to face top-surface ground electrode 14 and bottom-surface ground electrode 15, respectively. Similarly, first low-impedance wiring 18*a* and second low-impedance wiring 18*b* are arranged so as to face top-surface ground electrode 14 and bottom-surface ground electrode 15, respectively.

First high-impedance wiring 17*a* is arranged near and parallel to top-surface ground electrode 14. Second high-impedance wiring 17*b* is arranged near and parallel to bottom-surface ground electrode 15. First high-impedance wiring 17*a* and second high-impedance wiring 17*b* are arranged facing each other. Further, first columnar conductor 19*a* is connected to one end of first high-impedance wiring 17*a* and to one end of second high-impedance wiring 17*b* (both at the same side).

The second embodiment of the present invention is different from the first in the following points. That is, the other end of first high-impedance wiring 17*a* is connected to one end of first low-impedance wiring 18*a* arranged parallel to and not facing first high-impedance wiring 17*a* through second columnar conductor 19*b*. Similarly, the other end of second high-impedance wiring 17*b* is connected to one end of second low-impedance wiring 18*b* arranged parallel to and not facing second high-impedance wiring 17*b* through third columnar conductor 19*c*. With such a configuration, electromagnetic field coupling can be avoided between first high-impedance wiring 17*a* and first low-impedance wiring 18*a*. Similarly, electromagnetic field coupling can be avoided between second high-impedance wiring 17*b* and second low-impedance wiring 18*b*. Accordingly, a resonator can be designed easily.

Here, second low-impedance wiring 18*b* is arranged so as to face first low-impedance wiring 18*a*. The other end of first low-impedance wiring 18*a* is open with nothing connected thereto. Similarly, the other end of second low-impedance wiring 18*b* is open with nothing connected thereto.

The operation principle of the resonator according to the second embodiment of the present invention is the same as that of the first embodiment. Specifically, the resonance frequency of a resonator can be adjusted by adjusting the conductor lengths of first columnar conductor 19*a*, second columnar conductor 19*b*, and third columnar conductor 19*c*.

With such a configuration, a half-wavelength resonator can be structured three-dimensionally, thereby reducing the area size of the resonator.

Figure 10:
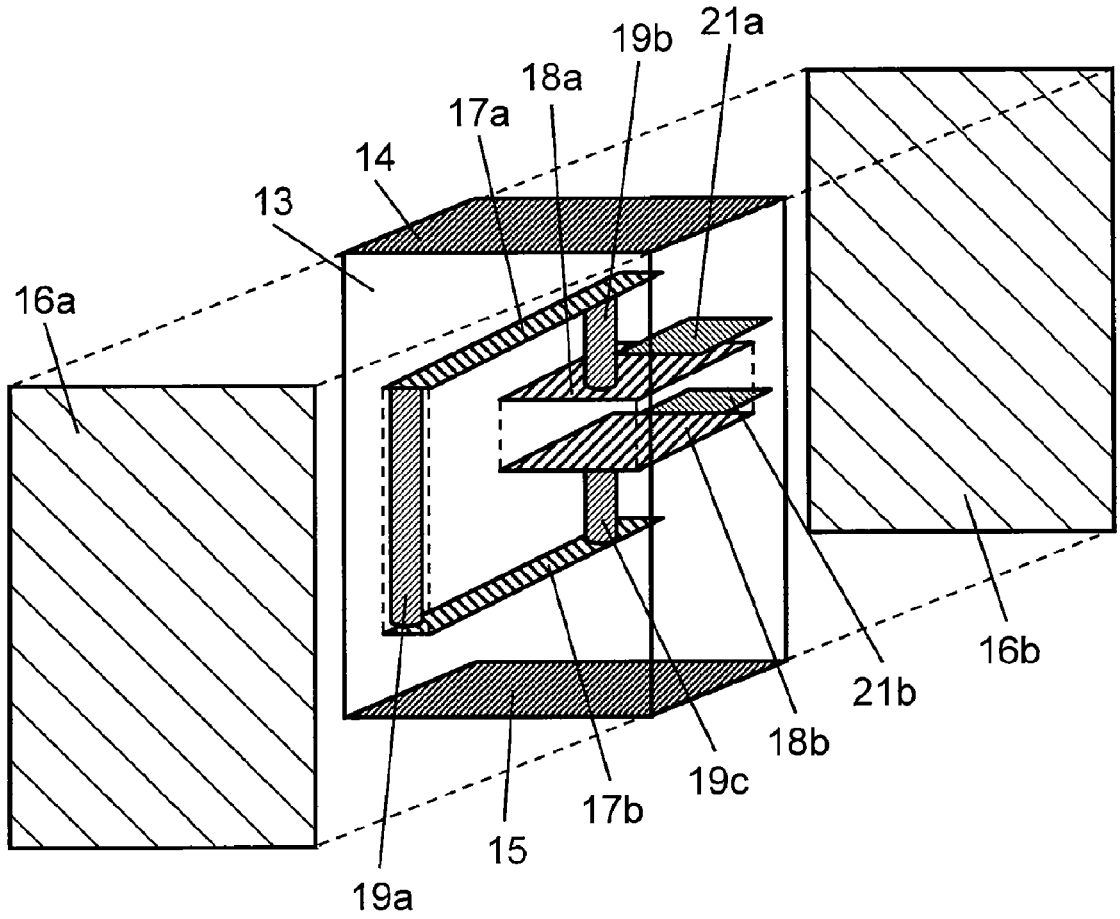
FIG. 10 is a perspective view of another resonator according to the second embodiment of the present invention.

FIG. 10 is a perspective view of another resonator according to the second embodiment of the present invention. In FIG. 10, loading capacitance 21*a* is provided between first low-impedance wiring 18*a* and first high-impedance wiring 17*a*, at the open end of first low-impedance wiring 18*a*. Similarly, loading capacitance 21*b* is provided between second low-impedance wiring 18*b* and second high-impedance wiring 17*b*, at the open end of second low-impedance wiring 18*b*. With such a configuration, the resonance frequency of the resonator can be further shifted toward a lower frequency.

In the second embodiment of the present invention, to avoid electromagnetic field coupling with another electronic appliance, side-surface ground electrodes 16*a*, 16*b*, top-surface ground electrode 14, and bottom-surface ground electrode 15 are desirably connected to each other electrically. The same effect is provided even if top-surface ground electrode 4 is electrically connected to bottom-surface ground electrode 15 using a columnar conductor instead of side-surface ground electrodes 16*a*, 16*b*.

In the second embodiment of the present invention, first high-impedance wiring 17*a* is different from second high-impedance wiring 17*b* in shape; first low-impedance wiring 18*a* is different from second low-impedance wiring 18*b* in shape, which allows a coupling device for such as I/O coupling and interstage coupling to be provided more easily. Further, second columnar conductor 19*b* is different from third columnar conductor 19*c* in conductor length, which allows a coupling device for such as I/O coupling and interstage coupling to be provided more easily. That is, such an asymmetric structure allows correcting fluctuation in impedance of the resonator caused by a coupling device.

Figure 11:
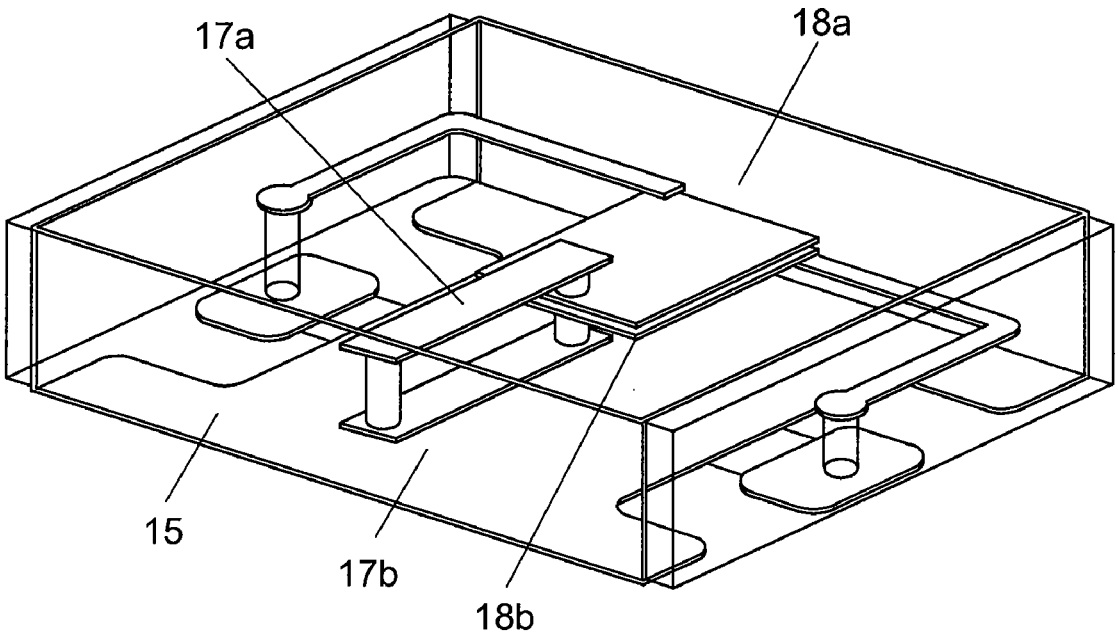
FIG. 11 is a perspective view showing another resonator according to the second embodiment of the present invention.
Figure 12:
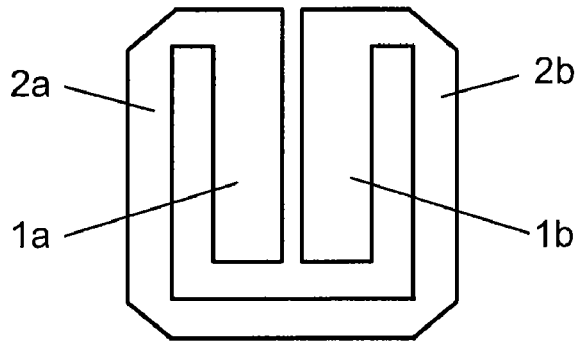
FIG. 12 PRIOR ART
FIG. 12 is a top view of a conventional resonator.

FIG. 11 is a perspective view showing another resonator according to the second embodiment of the present invention. In FIG. 11, enlarging the shape of bottom-surface ground electrode 15 provides a more stable ground surface.

Further, using two or more resonators of the present invention and connecting them through electromagnetic field coupling provides an ever-smaller filter. Incorporating the filter further reduces the size of an electronic device contained in a mobile phone and other appliances.

INDUSTRIAL APPLICABILITY

A resonator of the present invention provides an effect that reduces the area size and is useful for various types of electronic appliances such as a mobile phone.

The invention claimed is:

1. A resonator comprising:

a top-surface ground electrode;

a first high-impedance wiring, arranged parallel to the top-surface ground electrode;

a second high-impedance wiring, arranged so as to face the first high-impedance wiring, each of the first high-impedance wiring and the second high-impedance wiring formed as a plate-like structure;

a first columnar conductor electrically connecting the first high-impedance wiring to the second high-impedance wiring;

a first low-impedance wiring arranged between the first high-impedance wiring and the second high-impedance wiring and having an impedance lower than that of the first high-impedance wiring;

a second columnar conductor electrically connecting the first high-impedance wiring to the first low-impedance wiring;

a second low-impedance wiring arranged between the first low-impedance wiring and the second high-impedance wiring and having an impedance lower than that of the first high-impedance wiring; and a third columnar conductor electrically connecting the second high-impedance wiring to the second low-impedance wiring.

2. The resonator of claim 1, wherein the first columnar conductor is connected to one end of the first high-impedance wiring, and wherein the second columnar conductor is connected to an other end of the first high-impedance wiring.

3. The resonator of claim 2, wherein the first columnar conductor is connected to one end of the second high-impedance wiring, and wherein the third columnar conductor is connected to an other end of the second high-impedance wiring.

4. The resonator of claim 1, wherein a line width of the first high-impedance wiring is made smaller than that of the first low-impedance wiring.

5. The resonator of claim 4, wherein a line width of the second high-impedance wiring is made smaller than that of the second low-impedance wiring.

6. The resonator of claim 1, wherein a length of the second columnar conductor is equalized to that of the third columnar conductor.

7. The resonator of claim 1, wherein the second columnar conductor and the third columnar conductor are arranged on a same straight line.

8. The resonator of claim 1, wherein a length of the first columnar conductor is made larger than a sum of lengths of the second columnar conductor and the third columnar conductor.

9. A filter comprising the resonator of claim 1.

* * * * *